US005738489A

United States Patent [19]

Lee

[11] Patent Number: 5,738,489

[45] Date of Patent: Apr. 14, 1998

[54] COOLED TURBINE BLADE PLATFORM

[75] Inventor: Ching-Pang Lee, Cincinnati, Ohio

[73] Assignee: General Electric Company, Cincinnati, Ohio

[21] Appl. No.: 778,565

[22] Filed: Jan. 3, 1997

[51] Int. Cl.[6] ..... F01D 25/14

[52] U.S. Cl. ..... 415/177

[58] Field of Search ..... 415/115, 116, 415/177; 416/223 A

[56] References Cited

U.S. PATENT DOCUMENTS 5,348,446 9/1994 Lee et al. ..... 416/241 R 5,645,399 7/1997 Angus ..... 415/177

*Primary Examiner*—John T. Kwon

*Attorney, Agent, or Firm*—Andrew C. Hess; Patrick R. Scanlon

[57] ABSTRACT

A turbine blade includes a dovetail, shank, platform, and airfoil. A cooling circuit extends radially therethrough for circulating a coolant. A thermal conductor is disposed on a lower surface of the platform for conducting heat from the platform to the shank for removal by the coolant in the cooling circuit.

8 Claims, 2 Drawing Sheets

COOLED TURBINE BLADE PLATFORM

CROSS REFERENCE TO RELATED APPLICATION

The present invention is related to application Ser. No. 08/778,529, filed Jan. 3, 1997.

BACKGROUND OF THE INVENTION

The present invention relates generally to gas turbine engines, and, more specifically, to turbine blade cooling.

A gas turbine engine includes a compressor for pressurizing air which is channeled to a combustor wherein it is mixed with fuel and ignited for generating hot combustion gas. The combustion gas flows downstream through one or more turbine stages which extract energy therefrom for producing work. Since turbine blades are directly exposed to the hot combustion gas they are typically cooled using a portion of the compressed air bled from the compressor channeled through a cooling circuit therein. For high performance gas turbines having substantially high combustion gas temperature, the turbine blade utilizes various film cooling holes over the airfoil thereof for providing thin films of cooling air to protect the airfoil from the hot combustion gas which flows thereover.

A typical turbine blade includes a dovetail disposed in a complementary dovetail slot in a perimeter of a rotor disk for securing the blade thereto. A shank extends upwardly from the dovetail to a platform which defines a radially inner flowpath for the combustion gas. And, the airfoil extends upwardly from the platform for engaging the combustion gas and extracting energy therefrom for rotating the disk and producing power.

The blade may be cooled by variously configured cooling circuits and cooling holes through the airfoil. The cooling circuit extends from the bottom of the dovetail which first receives the coolant channeled thereto, and extends upwardly through the dovetail, shank, platform, and airfoil. The cooling circuit itself provides effective cooling of the dovetail, shank, and platform since they are disposed below the combustion gas flowpath, and the temperature profile of the combustion gas is typically center peaked.

The hottest combustion gas typically flows near the mid-span region of the airfoil and first engages the airfoil along its leading edge and pressure side. Accordingly, the leading edge and pressure side of the airfoil are typically provided with suitable film cooling holes for maximizing the cooling thereof for effecting a suitably long useful life of the blade during operation.

The efficiency of the gas turbine engine may be further increased by increasing the temperature of the combustion gas, which correspondingly increases the difficulty of cooling the turbine blade. And, undesirable exhaust emissions may be reduced by providing substantially flat temperature profiles for the combustion gas exiting the combustor which reduces the center-peaked temperature and effects a more radially uniform, yet high temperature profile. This further increases the complexity of adequately cooling the turbine blade since the heat load is being distributed more uniformly from the root to tip of the airfoil.

In particular, conventional blade platforms are relatively thin plate members which have no internal cooling circuits therein. The platform is conventionally cooled solely by the coolant channeled upwardly through the shank and center of the platform into the airfoil. Accordingly, conventional uncooled blade platforms are subject to substantial thermal distress in advanced, low emission turbine engines. However, since the platforms are relatively thin and project outwardly from the airfoil, providing cooling circuits therein while maintaining suitable strength thereof is a significant problem.

SUMMARY OF THE INVENTION

A turbine blade includes a dovetail, shank, platform, and airfoil. A cooling circuit extends radially therethrough for circulating a coolant. A thermal conductor is disposed on a lower surface of the platform for conducting heat from the platform to the shank for removal by the coolant in the cooling circuit.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DESCRIPTION OF THE PREFERRED EMBODIMENT(S)

Figure 1:
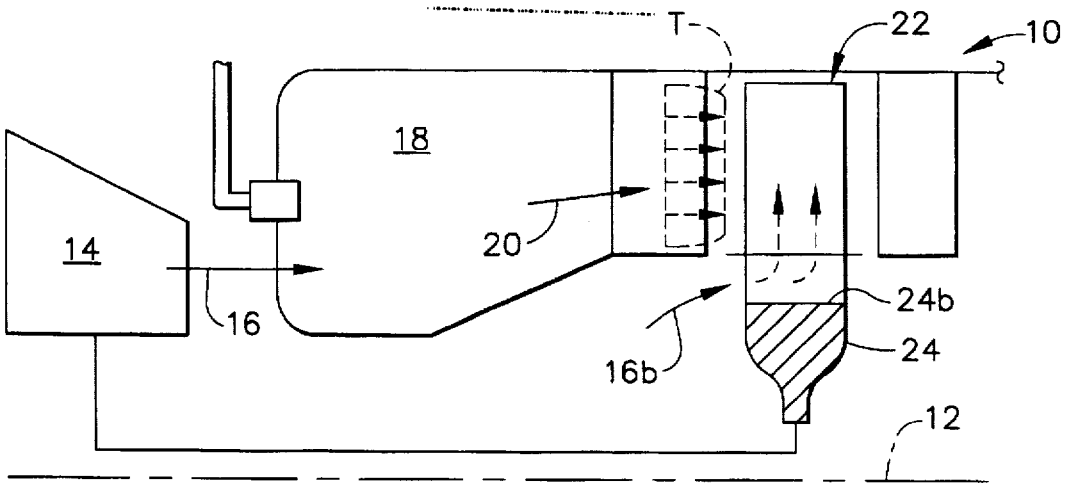
FIG. 1 is a schematic, axial elevational view of a portion of an axisymmetrical gas turbine engine including turbine blades in accordance with the present invention.

Illustrated schematically in FIG. 1 is an exemplary gas turbine engine 10 which is axisymmetrical about a longitudinal or axial centerline axis 12. The engine 10 is conventionally configured with a multistage axial compressor 14 which provides compressed air 16 to an annular combustor 18 wherein it is mixed with fuel and ignited for generating hot combustion gas 20 which is discharged into one or more turbine stages.

In accordance with the present invention, a plurality of circumferentially spaced apart turbine blades 22 extend radially outwardly from a rotor disk 24 to define a first stage turbine rotor which is suitably joined to the compressor 14 through a shaft for powering and rotating the compressor during operation.

In the exemplary embodiment illustrated in FIG. 1, the engine 10 is provided with an advanced low emissions combustor 18 which provides relatively high temperature combustion gas 20 with a substantially flat temperature profile designated T, which is generally uniform in a radial direction as opposed to being conventionally center-peaked as in typical turbine engines. The turbine blades 22 are cooled using a suitable coolant **16*b*, which in the exemplary embodiment illustrated in FIG. 1 is a portion of the compressed air 16 bled form the compressor 14 and suitably channeled to the rotor disk 24 for circulating radially upwardly through the individual blades 22** in a conventional manner.

Figure 2:
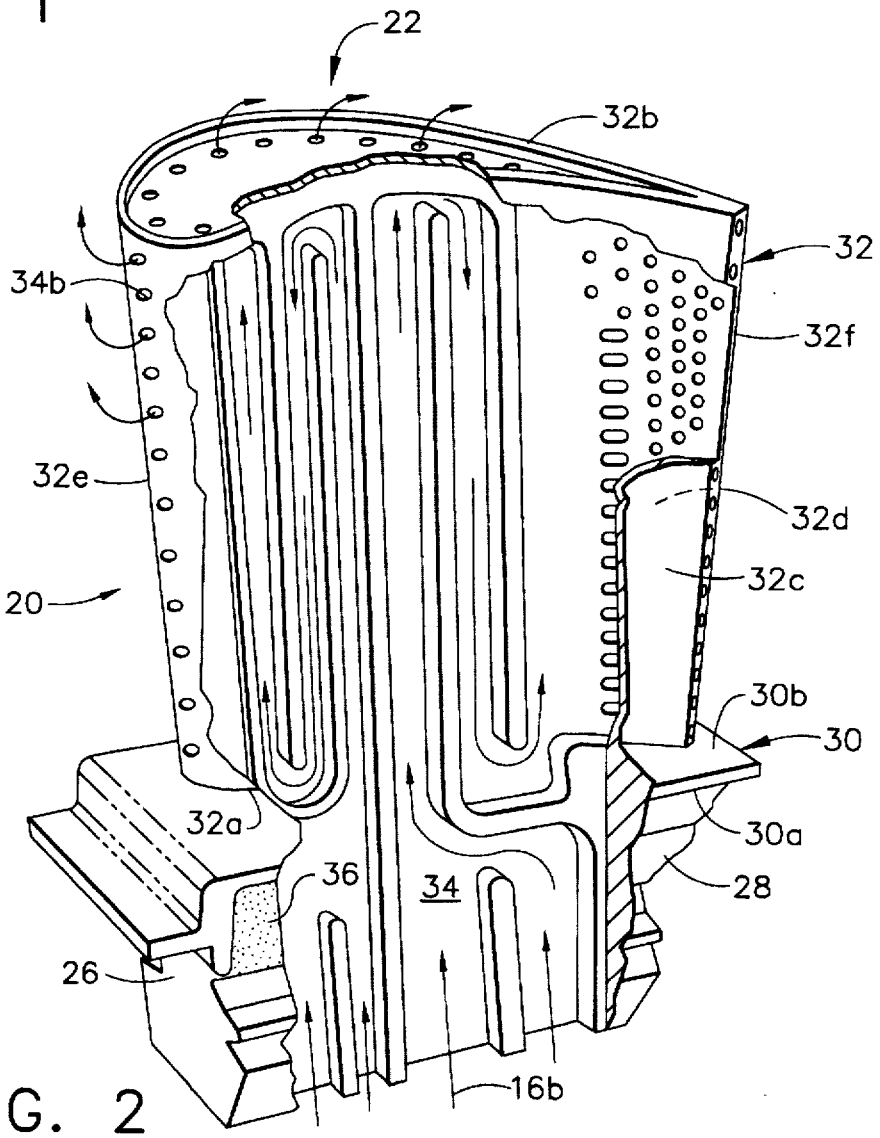
FIG. 2 is a partly sectional, isometric view of a first stage turbine blade of the engine illustrated in FIG. 1 in accordance with an exemplary embodiment of the present invention.

More specifically, an exemplary one of the turbine blades 22 is illustrated in FIG. 2 and includes a conventional dovetail 26 which may have any suitable form including suitable tangs which engage complementary tangs of a dovetail slot 24*b* (see FIG. 1) in the rotor disk 24 for radially retaining the blade 22 to the disk 24 as it rotates during operation. A generally smooth and uniform blade shank 28 extends radially upwardly from the dovetail 26 as required and terminates in a platform 30 which projects laterally outwardly from and surrounds the shank 28.

The platform 30 includes a radially lower surface 30*a* which faces radially inwardly or downwardly toward the shank 28 and dovetail 26. The platform 30 also includes an opposite, radially outwardly facing upper surface 30*b* which defines a radially inner flowpath or boundary for the combustion gas 20.

Extending radially upwardly from the platform 40 is an airfoil 32 over which is flowable the combustion gas 20. The airfoil extends radially from a root 32*a* to tip 32*b*, and has laterally opposite pressure and suction sides 32*c,d*. The pressure side 32*c* is generally concave and extends axially from a leading edge 32*e* to a trailing edge 32*f* of the airfoil.

A suitable cooling channel or circuit 34 extends radially upwardly through the dovetail 26, shank 28, platform 30, and airfoil 32 for channeling or circulating the coolant 16*b* therethrough for cooling the blade 22.

The blade may take any conventional form and configuration for expanding the combustion gas 20 and extracting energy therefrom for rotating the disk 24 during operation. It is typically formed as a one-piece casting of a suitable superalloy such as a nickel-based superalloy which has acceptable strength at the elevated temperatures of operation in the gas turbine engine. The cooling circuit 34 may also take any conventional form including various passages through the airfoil with various cooling features such as discharge holes 34*b* which may take the form of film cooling holes for improving cooling of the airfoil 32 during operation.

In accordance with the present invention, the otherwise conventional turbine blade 22 includes a thermal conductor 36 which is disposed on the platform lower surface 30*a* for conducting heat from the platform 30 to the shank 28 for removal by the coolant 16*b* in the cooling circuit 34. The preferred location of the thermal conductor 36 on the blade 22 is illustrated in more particularity in FIGS. 3 and 4. Since the dovetail 26, shank 28, platform 30, and airfoil 32 are preferably a one-piece blade component typically formed as a nickel-based superalloy, single crystal casting, they have a common blade thermal conductivity of about 13 BTU/Hr-Ft-°F., for example.

The platform 30 is a relatively thin solid member which projects laterally outwardly from the root of the airfoil and is therefore difficult to cool especially when the combustion gas temperature profile is relatively flat and elevated. In this situation, the platform 30 experiences a relatively high thermal load which must be suitably dissipated for ensuring a suitable life of the platform 30 itself.

The thermal conductor 36 has a substantially greater thermal conductivity than that of the remainder of the blade 22, and correspondingly typically has a substantially lower ductility rendering it relatively brittle and subject to damage if it is not suitably protected. A suitable conductor 36 for this turbine environment may include nickel aluminide (NiAl), chromium, or NiAl—Cr, for example. Nickel aluminide, for example, has a thermal conductivity of about 40 BTU/Hr-Ft-°F., which is about three times greater than that of the superalloy base material of the platform 30 itself.

Since the platform upper surface 30*b* is directly exposed to the combustion gas 20, it is not desirable to place the thermal conductor on the upper surface which could aggravate the cooling problem and subject the thermal conductor to undesirable cracking. By placing the thermal conductor 36 on the lower surface 30*a* of the platform, it is protected from the combustion gas 20 by the platform 30 itself, and, more importantly, provides an additional and enhanced thermal conduction path from the platform 30 to the shank 28 so that the coolant 16*b* channeled through the cooling circuit 34 may remove heat by convection. The conductor 36 is preferably not covered by additional material, but is directly exposed to the space between the platform and disk 24, through which may flow cool purge air.

Figure 4:
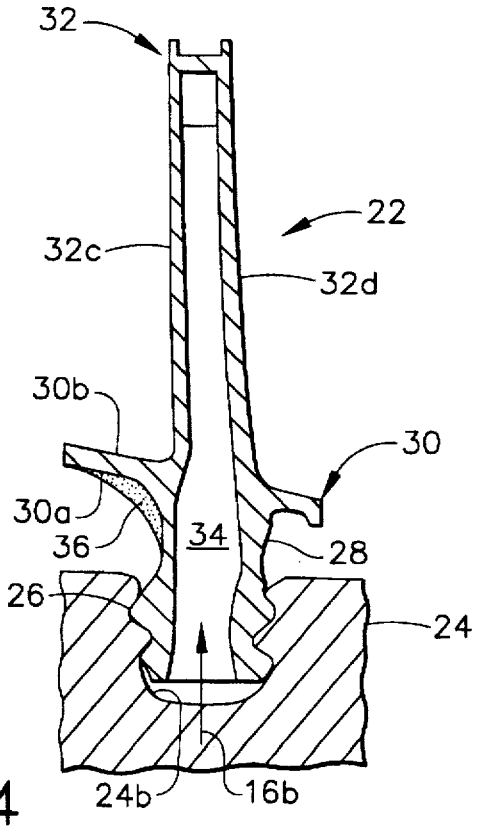
FIG. 4 is a radial sectional view of the turbine blade illustrated in FIG. 3 and taken generally along line 4—4, and mounted in a turbine rotor disk.

As shown in FIG. 4, the conductor 36 preferably bridges the platform 30 and the shank 28 for conducting heat to the shank 28 over a greater surface area for improving cooling of the platform 30. The conductor 36 preferably extends from the perimeter of the platform 30, along the lower surface 30*a* to the shank 28, then at least in part along the shank 28 toward the dovetail 26. The conductor 36 also preferably tapers or terminates to a minimum thickness at its opposite ends at both the platform perimeter and just above the dovetail 26. In this way the conductor 36 may have its maximum thickness at its center at the platform-shank junction, which is substantially greater than the thickness at its edges to maximize heat conduction.

As shown in FIG. 4, the shank 28 positions the platform 30 at a suitable radius spaced above the outer perimeter of the rotor disk 24. The shank 28 therefore may have various radial heights depending upon the particular engine application. The conductor, correspondingly, may extend from the platform 30 radially inwardly as far as desired to suitably above the dovetail 26 to ensure that it does not interfere with the retention function of the dovetail 26 in the disk 24. The function of the thermal conductor 36 is to provide an additional thermal conduction path from the solid platform 30 to the internal cooling circuit 34 along as much of the shank 28 as desirable within the available surface area thereof. The greater thermal conductivity of the conductor 36 as compared to the platform 30 and shank 28 substantially increases the amount of heat which may be removed from the platform 30 and carried to the shank 28 from which it is removed by convection in the coolant 16*b* channeled radially upwardly through the blade 22.

The conductor 36 may be fixedly joined to the blade 22 using any conventional process such as brazing, or plasma deposition, or being electron beam melted thereon. The blade 22 may be otherwise conventional, with the conductor 36 being suitably added thereto as desired.

The thermal conductor 36 may be located below the platform 30 at any suitable location subject to relatively high heat load. For example, the pressure side 32*c* of the airfoil 22 is typically subject to the highest heat load from the combustion gas 20, which therefore imparts the correspondingly high heat load into the pressure side platform 30. Accordingly, the conductor 36 may be disposed on the platform lower surface 30*a* only on the pressure side 32*c* as illustrated in FIG. 4. If it is desired to additionally cool the platform 30 on the suction side of the airfoil, the conductor 36 may also be added to that side of the blade.

Figure 3:
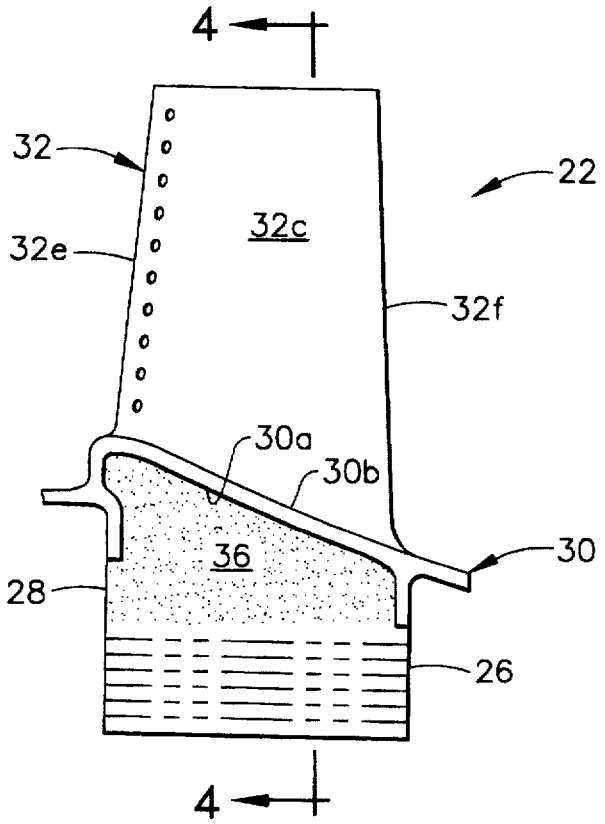
FIG. 3 is an elevational, pressure-side view of the turbine blade illustrated in FIG. 2 showing a thermal conductor bridging the platform and shank in accordance with an exemplary embodiment of the present invention for providing enhanced platform cooling.

As shown in FIG. 3, the coverage of the thermal conductor 36 may be axially maximized by being disposed on the platform lower surface 30*a* and shank 28 from about the leading edge 32 to about the trailing edge 32*f* of the airfoil 32.

Since the thermal conductor 36 may be bonded to the external surface of the shank 28 and platform 30, the application process is relatively simple and may be applied to an existing blade without design modifications thereof. The thermal conductor 36 may therefore be retrofitted to existing blade designs where space permits for thereby improving cooling of the blade platform.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims:

I claim:

1. A turbine blade comprising:

a dovetail for mounting said blade to a rotor disk;

a shank extending from said dovetail;

a platform joined to said shank, and having a lower surface facing downwardly toward said shank, and an opposite upper surface defining a radially inner flowpath;

an airfoil extending upwardly from said platform over which is flowable combustion gas;

a cooling circuit extending radially upwardly through said dovetail, shank, platform, and airfoil for circulating a coolant therethrough for cooling said blade; and a thermal conductor disposed on said platform lower surface for conducting heat from said platform to said shank for removal by said coolant in said cooling circuit.

2. A blade according to claim 1 wherein said dovetail, shank, platform, and airfoil are a one-piece blade component with a common thermal conductivity, and said conductor has a greater thermal conductivity.

3. A blade according to claim 2 wherein said conductor bridges said platform and said shank for conducting heat to said shank.

4. A blade according to claim 3 wherein said conductor extends from a perimeter of said platform, along said lower surface to said shank, and at least in part along said shank toward said dovetail.

5. A blade according to claim 4 wherein said conductor tapers to a minimum thickness at both said platform perimeter and said dovetail.

6. A blade according to claim 5 wherein said airfoil has opposite pressure and suction sides, and said conductor is disposed on said platform lower surface only on said pressure side.

7. A blade according to claim 5 wherein said airfoil has opposite leading and trailing edges, and said conductor is disposed on said platform lower surface from about said leading edge to about said trailing edge.

8. A blade according to claim 5 wherein said conductor is selected from the group consisting of NiAl, chromium, and NiAl—Cr.

* * * * *